United States Patent [19]

Novak

[11] Patent Number: 4,852,450

[45] Date of Patent: Aug. 1, 1989

[54] FINGERBOARD FOR A STRINGED INSTRUMENT

[76] Inventor: Ralph Novak, 638 Dowling Blvd., San Leandro, Calif. 94577

[21] Appl. No.: 214,006

[22] Filed: Jun. 30, 1988

[51] Int. Cl.[4] ..... G10D 3/04

[52] U.S. Cl. ..... 84/314 R

[58] Field of Search ..... 84/314 R, 267

[56] References Cited

U.S. PATENT DOCUMENTS

| | | | |
|---|---|---|---|
| 652,353 | 6/1900 | Edgren | 84/314 R |
| 1,578,744 | 3/1926 | Manby | 84/314 R |
| 3,103,846 | 9/1963 | Webster | 84/314 R |
| 4,023,460 | 5/1977 | Kuhnke | 84/314 R |

OTHER PUBLICATIONS

Rickenbacker 1974, The Electric Guitar: It's History and Construction, pp. 80 & 81.

*Primary Examiner*—Lawrence R. Franklin

*Attorney, Agent, or Firm*—Bielen & Peterson

[57] ABSTRACT

A fingerboard or fret board for a stringed instrument utilizing a neck portion including a surface over which a plurality of strings are tensioned between a saddle of a bridge and a nut. Also, included are a series of straight frets which are aligned in a non-parallel pattern relative to one another to provide ach string with a different scale length.

3 Claims, 1 Drawing Sheet

FINGERBOARD FOR A STRINGED INSTRUMENT

BACKGROUND OF THE INVENTION

The present invention relates to a novel construction for a fingerboard for a stringed instrument such as a guitar.

The scale length of a stringed instrument is defined as the "vibrating string length" or "speaking length" of a particular string on an instrument. The "vibrating string length" is fixed by the location between the nut and saddle along the fret board found on the neck portion of the instrument. The "scale length" lends a "color" to the overall tone of the instrument. For example, a guitar manufacturer typically chooses a scale length for all the strings of a guitar e.g. Gibson-twenty four and five/sixteenths inches: Fender-25½"; Martin-24.9". Each particular scale length chosen accentuates various harmonic components of the vibrating string. In addition, different scale lengths require different string tensions, which in turn affect the string harmonics. It should be noted that a chosen scale length will also have a particular fret spacing to coincide with the related pitches of the fretted notes. For example, "The Electric Guitar: It's History & Construction", Rickenbacker, 1974, Pg. 80 & 81 includes published tables for accurate fret spacing measurement.

Unfortunately, fixing a scale length for a guitar, for example, limits tonal flexibility in that improving the tone of the lower strings causes the tone of the higher strings to suffer and visa versa. That is to say, "flabby" sounding low strings may be tonally improved by increasing the scale length and tension of such lower strings. At the same time, the tension of the treble strings must be increased, making such strings difficult to play and creating a tonal imbalance.

A stringed instrument which includes different scale lengths for the treble and bass strings would be a great advance in the design of stringed instruments.

SUMMARY OF THE INVENTION

In accordance with the present invention a novel and useful fingerboard for a stringed instrument is provided, which permits the achievement of tonal flexibility not found in the prior art.

The fingerboard of the present invention utilizes a neck and connected body of the prior art. The neck provides a surface over which are stretched a plurality of strings between a nut and a saddle at the bridge portion of the instrument. Such strings may be tensioned in the conventional manner, i.e., by a series of pegs and keys found on a peghead.

The invention also includes the use of a series of frets each of which are extended along a straight line. At least two of the frets are not parallel to one another. In certain cases, each of the frets would extend along a straight line in a non-parallel pattern relative to one another. Such straight lines would converge to a point. Also, the nut and saddle may be constructed to extend along straight lines which are not parallel to one another and which may converge to the same point as the fret lines. In another aspect of the present invention, the neck may be defined to extend along an axis and the fret lines may be arranged such that they are perpendicular to such an axis. Also, in certain embodiments of the invention, the fret lines would intersect the neck axis at different angles, one of which may lie perpendicular to such neck axis.

Thus, a stringed instrument, such as a guitar, of the present invention may be constructed to include a rather long scale for the bass strings and a short scale for the treble strings.

It may be apparent that a novel and useful fingerboard for a stringed instrument has been described.

It is therefore an object of the present invention to provide a fingerboard for a string instrument which employs multiple stringed lengths for each of the strings associated therewith to maximize tonal flexiblity.

It is another object of the present invention to provide a fingerboard for a stringed instrument which possesses versatility in determining string tensions for each of the strings thereof.

A further object of the present invention is to provide a fingerboard for a stringed instrument which possesses improved intonation and definition of the lower strings.

Yet another object of the present invention is to provide a fingerboard for a stringed instrument which may be customized according to desired "feel" and tonal characteristics.

A further object of the present invention is to provide a fingerboard for a stringed instrument which permits stringed instrument builders to gain increase tonal control not possible in the prior art.

Yet another object of the present invention is to provide a stringed instrument which possesses a unique appearance.

The invention possesses other objects and advantages especially as concern particular characteristics and features thereof which will become apparent as the specification continues.

Figures 1, 2, 3, 4:
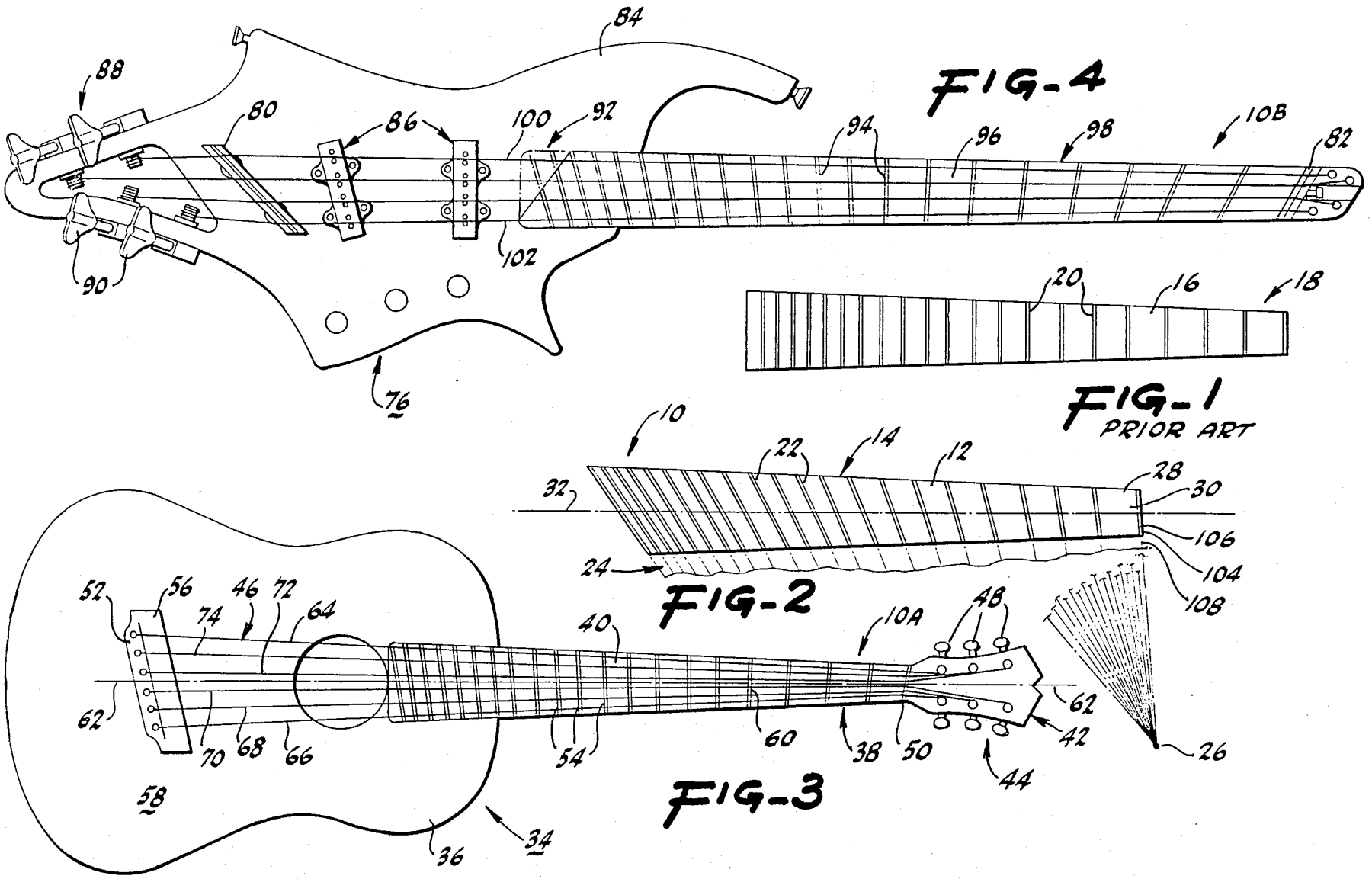
FIG-1 PRIOR ART
FIG. 1 is a plan view of a fingerboard of a prior art guitar.
FIG. 2 is a plan view of a fingerboard of the present invention including a schematic representation of convergence of fret lines to a point.
FIG. 3 is a plan view of an acoustical guitar utilizing a fingerboard of the present invention.
FIG. 4 is a plan view of an electric bass guitar utilizing a fingerboard of the present invention.

For a better understanding of the invention reference is made to the following detailed description of the preferred embodiments thereof which should be referenced to the hereinabove described drawings.

DESCRIPTION OF THE PREFERRED EMBODIMENTS

Various aspects of the present invention will evolve from the following detailed description of the preferred embodiments thereof which should be noted in accordance with the hereinabove described drawings.

The invention as a whole is depicted in the drawings by reference character 10 and the reference character 10 followed by upper case letters for various embodiments of the same. The fingerboard 10, FIG. 2, utilizes a surface 12 which is normally part of a neck 14 connected to a sound box or body (not shown on FIG. 2). With reference to FIG. 1 it may be observed that the prior art fingerboard also includes a surface 16 on one side of neck 18 which is also intended for connection to a body (not shown in FIG. 1).

It should be noted that a significant difference exists between FIG. 1 and FIG. 2 in that plurality of frets 20 on FIG. 1 are parallel to one another and of varied spacing according to the "rule of 18" or from published tables.

Turning to FIG. 2 it may be observed that plurality of frets 22 associated with the present invention are not parallel to each other, although being of varied spacing at each point along the axis, 32 according to the same rule or tables. Each of the plurality of frets 22 extends along one of the plurality of lines 24 which converge to a point 26. Thus, a bass string tensioned along the edge portion 28 of fingerboard 10 would possess a scale length longer than a treble string tensioned along edge portion 30 of fingerboard 10. It should also be apparent that such a treble string would be tensioned to a lower degree than a treble string possessing the scale length of a bass string tensioned along edge portion 28, hereinabove described.

Assuming an axis 32 runs along surface 12 of neck 14, plurality of lines 24 would each intersect axis 22 at a different angle. It may be realized that none of the plurality of lines 24 would be perpendicular to axis 32 in this regard with respect to fingerboard 10, FIG. 2.

Now turning to FIG. 3, an acoustical guitar 34 is depicted employing fingerboard 10A of the present invention. Acoustical guitar 34 includes a sound box or body 36 connected to neck 38 having a surface 40. Neck 38 terminates in a peghead 42 which includes means 44 for tensioning plurality of strings 46. Tensioning means 44 possesses a multiplicity of pegs and keys 48, in the conventional construction. Multiplicity of strings 46 pass over nut 50, saddle 52, and a plurality of frets 54. Saddle 52 extends upwardly from bridge 56 on the upper surface 58 of sound box 36. Plurality of frets 54, are again not parallel to each other and lie along lines which converge to a point in the manner shown in FIG. 2. Nut 50 and saddle 52 also follow the non-parallel configuration of the frets. It should be noted, however, that fret 60 lies almost perpendicular to neck axis 62 but plurality of straight frets 54 each form a different angle with intersecting axis 52. Further, bass string 64 has a longer scale length than treble string 66. The scale length of strings 68, 70, 72, and 74 progressively increase.

With reference to FIG. 4, it may be apparent that an electric guitar 76 is illustrated having a plurality of strings tensioned between saddle 80 and nut 82. Body 84, of course, does not include a sound hole, rather, electrical pickup 86 produces an electrical signal to an amplifier and speaker system by a known process (not shown). Tensioning means 88 includes a conventional set of pegs and keys 90. Similarly, plurality of frets 94 on surface 96 of neck 98 progressively slant from right to left and lie on lines which converge to a point, similar to point 26 on FIG. 2. As is the case for acoustical guitar 34 of FIG. 3, electric guitar 76 possesses a bass string 100 which has a longer scale length than treble string 102. It should be noted that surface 96 includes a phantom portion 92, on FIG. 4, which may be incorporated into the embodiment shown in FIG. 4 to produce bass notes generated by string 100 by frets extending to treble string 102. The following table depicts illustrative lengths for top string 100 and bottom string 102 from nut 82 to the middle of each of the plurality of frets 94, numbered 1–22 for an accuracy of ±1/16":

| FRET # | DISTANCE OF STRING 102 FROM NUT 82 IN INCHES | DISTANCE OF STRING 100 FROM NUT 82 IN INCHES |
|---|---|---|
| 1 | 1 15/16 | 2 1/16 |
| 2 | 3¾ | 4 |
| 3 | 5 5/16 | 5 13/16 |
| 4 | 7 1/16 | 7 9/16 |
| 5 | 8 9/16 | 9¼ |
| 6 | 10 | 10 13/16 |
| 7 | 11⅜ | 12¼ |
| 8 | 12⅝ | 13⅝ |
| 9 | 13⅞ | 15 |
| 10 | 15 | 16¼ |
| 11 | 16 1/16 | 17 7/16 |
| 12 | 17⅛ | 18½ |
| 13 | 18 1/16 | 18⅝ |
| 14 | 18 15/16 | 20 9/16 |
| 15 | 19¾ | 21½ |
| 16 | 20⅝ | 22⅜ |
| 17 | 21⅜ | 23 3/16 |
| 18 | 22⅛ | 24 |
| 19 | 22¾ | 23 11/16 |
| 20 | 23⅜ | |
| 21 | 24 | |
| 22 | 25 1/16 | |
| Saddle 80 | 34¼ | |

In operation, fingerboard 10, 10A and 10B are connected to conventional bodies for stringed instruments such as acoustic or electric guitars. The plurality of frets 22, 54, and 94 for fingerboards 10, 10A and 10B, respectively, are inset in the conventional manner along lines which converge to a point such as point 26. Typically, the string instrument maker would start with the nut of the guitar and extend a line therethrough and determine the position of the end of the first fret such as end 104 of fret 106 along edge portion 30 of fingerboard 10, FIG. 2. A line 108 will then be drawn through fret 106 and intersects the line through the nut at a certain distance from fingerboard 10. Subsequent frets would then be determined according to the rule of 18, but possess the slant determined by a line through that fret through the point of the intersection of the lines through fret 106 and the nut. The strings of the instruments on the fingerboard so determined would then be tensioned and tuned. It should be noted that although the embodiments depicted in the drawings show bass strings with longer scale lengths than treble strings, the reverse could be true. Alternatively, a scale length for a treble string for example string 102 of FIG. 4, may be chosen. Fret spacings would then be marked along surface 96 according to published tables. A similar layout would occur for a bass string, e.g. string 100. The fret points for both layouts would be connected by straight (slanted) lives to determine the final fret layout or pattern.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A fingerboard for a stringed instrument having a sound box comprising:

a. a neck portion including a surface, said neck portion linked to the sound box;

b. a plurality of strings passing over a saddle and a nut along said neck portion;

c. means for tensioning said plurality of strings along said neck between said bridge and said nut; and d. a series of frets, each of said frets extending along a straight line, such that at least two of said straight lines are not parallel to one another, such that each of said strings possesses a different scale length, at least three of said straight lines associated with said plurality of strings substantially converging to a point, said saddle and nut extending along straight lines that substantially converge to said point of convergence of said three lines associated with three of said series of strings.

2. The fingerboard of claim 1 in which said neck lies along an axis and said lines associated with each of said frets intersects said neck axis.

3. The fingerboard of claim 2 in which each of said lines associated with each of said frets intersect said neck axis at a different angle.

* * * * *